US008824918B2

(12) United States Patent
Kashiide et al.

(10) Patent No.: US 8,824,918 B2
(45) Date of Patent: Sep. 2, 2014

(54) DEVELOPER ACCOMMODATING UNIT, PROCESS CARTRIDGE, ELECTROPHOTOGRAPHIC IMAGE FORMING APPARATUS

(71) Applicant: Canon Kabushiki Kaisha, Tokyo (JP)

(72) Inventors: Yosuke Kashiide, Tokyo (JP); Junichi Matsumura, Numazu (JP); Masaki Furutani, Tokyo (JP); Masaaki Matsushita, Yokohama (JP); Tetsuo Uesugi, Kawasaki (JP); Hiroomi Matsuzaki, Mishima (JP); Tatsuo Fujisaki, Yokohama (JP); Kojiro Yasui, Numazu (JP); Kazuki Matsumoto, Fuji (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/951,663

(22) Filed: Jul. 26, 2013

(65) Prior Publication Data

US 2013/0308973 A1 Nov. 21, 2013

Related U.S. Application Data

(63) Continuation of application No. PCT/JP2012/068527, filed on Jul. 13, 2012.

(30) Foreign Application Priority Data

Jul. 14, 2011 (JP) ..... 2011-155834
May 30, 2012 (JP) ..... 2012-123490

(51) Int. Cl.
*G03G 15/08* (2006.01)

(52) U.S. Cl.
USPC ..... 399/106

(58) Field of Classification Search
CPC ..... G03G 15/0822; G03G 15/0877; G03G 15/0887; G03G 21/16; G03G 21/1839; G03G 15/0832; G03G 15/0841; G03G 15/0843; G03G 15/0874; G03G 15/0837; G03G 15/0834
See application file for complete search history.

(56) References Cited

U.S. PATENT DOCUMENTS 5,594,535 A * 1/1997 Beaufort et al. ..... 399/262
5,832,343 A 11/1998 Kobayashi et al.

(Continued)

FOREIGN PATENT DOCUMENTS

JP 04-066980 A 3/1992
JP 05-173419 A 7/1993

(Continued)

OTHER PUBLICATIONS

PCT International Search Report and the Written Opinion dated Oct. 9, 2012.

(Continued)

*Primary Examiner* — Clayton E Laballe
*Assistant Examiner* — Victor Verbitsky
(74) *Attorney, Agent, or Firm* — Fitzpatrick, Cella, Harper & Scinto

(57) ABSTRACT

A developer accommodating unit for accommodating a developer for image formation includes a developer accommodating container including a flexible container provided with openings for permitting discharge of the accommodated developer and sealing member for sealing the openings by a bonding portion and for exposing the openings by being moved, an unsealing member, mounted on the sealing member, for moving the sealing member, and a frame which accommodates the developer accommodating container and the unsealing member and which includes a fixing portion for fixing the flexible container. In addition, connecting potion is disposed between the openings in the flexible container. With respect to an unsealing direction of the sealing member, the fixing portion and the connecting portion are provided so as to overlap with each other.

10 Claims, 16 Drawing Sheets

(56) References Cited

U.S. PATENT DOCUMENTS

| | | | | |
|---|---|---|---|---|
| 6,763,215 | B1 * | 7/2004 | Jones | 399/260 |
| 6,839,529 | B2 | 1/2005 | Yasui et al. | |
| 2011/0255898 | A1 | 10/2011 | Kashiide et al. | |

FOREIGN PATENT DOCUMENTS

| | | | |
|---|---|---|---|
| JP | 05-241447 | A | 9/1993 |
| JP | 09-006105 | A | 1/1997 |
| JP | 09-106156 | A | 4/1997 |
| JP | 2002-169366 | A | 6/2002 |
| JP | 2003-263014 | A | 9/2003 |

OTHER PUBLICATIONS

U.S. Appl. No. 13/951,563, filed Jul. 26, 2013.

* cited by examiner (a)

(b)

(c)

(a)

(b)

DEVELOPER ACCOMMODATING UNIT, PROCESS CARTRIDGE, ELECTROPHOTOGRAPHIC IMAGE FORMING APPARATUS

This application is a continuation of PCT Application No. PCT/JP2012/068527, filed on Jul. 13, 2012.

TECHNICAL FIELD

The present invention relates to an electrophotographic image forming apparatus, and a developer accommodating unit and a process cartridge which are used in the electrophotographic image forming apparatus.

Here, the electrophotographic image forming apparatus forms an image on a recording material (medium) by using, e.g., an electrophotographic image forming process. For example, an electrophotographic copying machine, an electrophotographic printer (e.g., an LED printer, a laser beam printer, etc.), an electrophotographic facsimile machine and the like included (hereinafter, referred to as an image forming apparatus).

Further, the process cartridge refers to one made detachably mountable to an image forming apparatus main assembly by integrally constituting a developing device and one made detachably mountable by integrally constituting the developing device and a photosensitive member unit including at least a photosensitive member.

Further, a developer accommodating member and the developer accommodating unit are accommodated in the above-described image forming apparatus or the above-described process cartridge. The developer accommodating member and the developer accommodating unit at least include a flexible container for accommodating a developer.

BACKGROUND ART

In a conventional electrophotographic image forming apparatus using the electrophotographic image forming process, a process cartridge type in which an electrophotographic photosensitive member and process means acting on the photosensitive member are integrally assembled into a cartridge and this cartridge is made detachably mountable to an electrophotographic image forming apparatus main assembly is employed.

In such process a cartridge, as shown in FIG. 15, an opening (portion) provided to a developer accommodating frame 31 for accommodating the developer (toner, carrier, etc.) is sealed with a sealing member. A type in which a bonding portion 33 of a toner seal 32 as the sealing member is peeled off when used and thus the opening is unsealed (opened) to permit feeding of the developer has been widely used (Japanese Laid-Open Patent Application (JP-A) Hei 4-66980).

Further, a process cartridge in which an inner container is made deformable in order to solve a problem that the developer is scattered in the process cartridge in a developer filling step during manufacturing of the process cartridge has been devised (JP-A Hei 4-66980).

Further, the process cartridge is constituted so that the opening largely opens, after being unsealed by an unsealing member, by providing an elastic member inside the deformable inside container (JP-A Hei 4-66980).

DISCLOSURE OF THE INVENTION

However, as in JP-A Hei 4-66980, it is difficult to provide the elastic member inside the inner container during manufacturing, and the provision of the elastic member is costly in some cases.

Therefore, an object of the present invention is, in a constitution different from the conventional constitution, to propose a developer accommodating unit which uses a flexible container and which is excellent in an unsealing property.

One constitution of the present invention according to the present application is the following one.

One constitution of the present invention is a developer accommodating unit for accommodating a developer for image formation, comprising: a developer accommodating container including a flexible container provided with openings for permitting discharge of the accommodated developer and including a sealing member for sealing the openings by a bonding portion and for exposing the openings by being moved; an unsealing member, mounted on the sealing member, for moving the sealing member; and a frame which accommodates the developer accommodating container and the unsealing member and which includes a fixing portion for fixing the flexible container, wherein a portion between the openings of the openings is a connecting portion, and wherein with respect to an unsealing direction of the sealing member, the fixing portion and the connecting portion are provided so as to overlap with each other.

According to the present invention, in the constitution different from the conventional constitution, it is possible to provide the developer accommodating unit which uses the flexible container and which is excellent in the unsealing property.

DESCRIPTION OF BEST MODE FOR CARRYING OUT THE INVENTION

A developer accommodating container refers to one including at least a flexible container and a sealing member for sealing an opening, provided to the flexible container, for permitting discharge of a developer.

A developer accommodating unit includes at least the developer accommodating container and a frame for accommodating the developer accommodating container.

(Embodiment 1)

Figure 2:
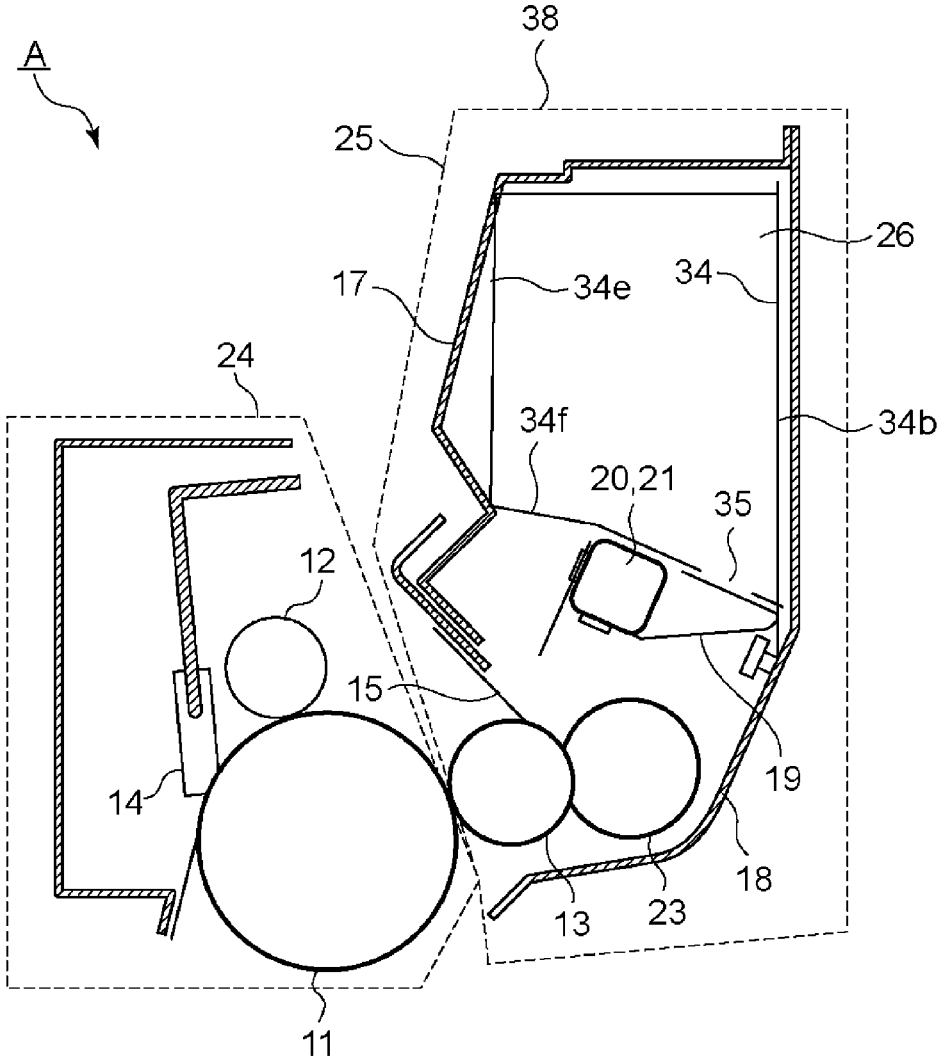
FIG. 2 is a principal sectional view of a process cartridge in the embodiment of the present invention.
Figure 3:
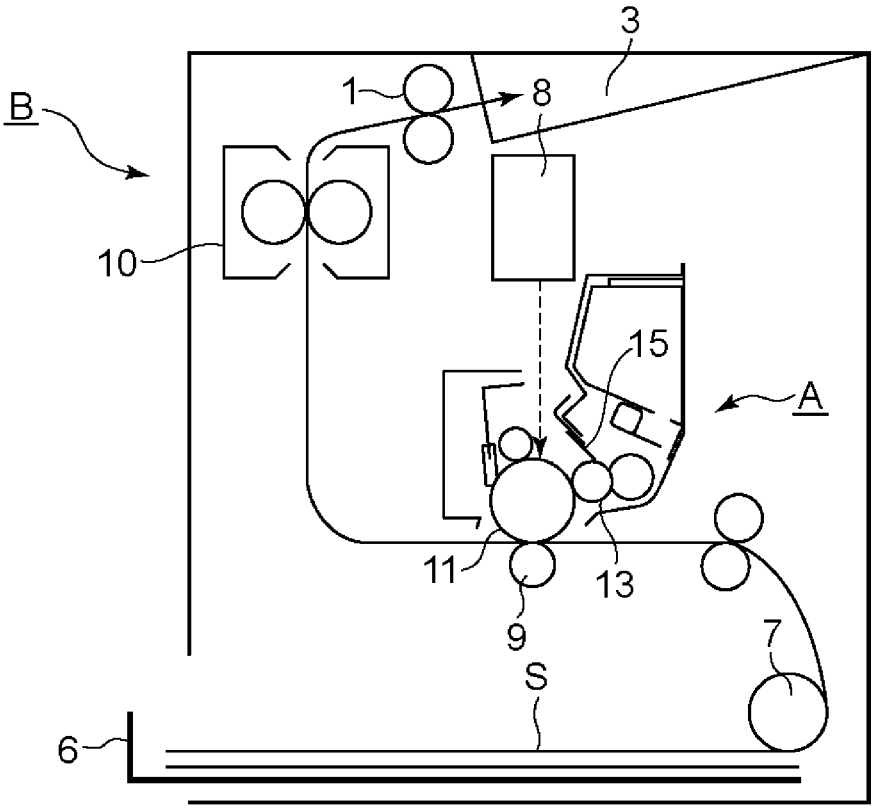
FIG. 3 is a principal sectional view of an image forming apparatus in the embodiment of the present invention.

FIG. 2 illustrates a principal sectional view of a process cartridge to which the present invention is applicable, and FIG. 3 illustrates a principal sectional view of an image forming apparatus to which the present invention is applicable.

<Summary of Constitution of Process Cartridge>

The process cartridge includes a photosensitive (member) drum and process means actable on the photosensitive drum. Here, as the process means, there are, e.g., a charging means for electrically charging a surface of the photosensitive drum, a developing device for forming an image on the photosensitive drum, and a cleaning means for removing a developer (containing toner, carrier, etc.) remaining on the photosensitive drum surface.

A process cartridge A in this embodiment includes, as shown in FIG. 2, at a periphery of a photosensitive drum 11, a charging roller 12 as the charging means and a cleaner unit 24 including a cleaning blade 14, having elasticity, as the cleaning means. Further, the process cartridge A includes a developing device 38 including a first frame 17 and a second frame 18. The process cartridge A is constituted by integrally assembling the cleaner unit 24 and the developing device 38, and is constituted so as to be detachably mountable to an image forming apparatus main assembly B as shown in FIG. 3. The developing device 38 as a developing means includes a developing roller 13, a developing blade 15, a developer supplying roller 23, and a developer accommodating container 26 including a developer accommodating member 34 which is a flexible container for accommodating the developer and including a sealing member 19. Hereinafter, such a developer accommodating container is referred to as the developer accommodating container 26. The developing roller 13 and the developing blade 15 are supported by the first frame 17.

<Summary of Constitution of Image Forming Apparatus>

The process cartridge A is mounted in the image forming apparatus main assembly B as shown in FIG. 3 and is used for image formation. In the image formation, a sheet S is fed by a feeding roller 7 from a sheet cassette 6 mounted at a lower portion of the image forming apparatus and in synchronism with this sheet feeding, the photosensitive drum 11 is selectively exposed to light by an exposure device 8 to form a latent image. The developer is supplied to the developing roller 13 (developer carrying member) by the developer supplying roller 23 having a sponge shape and is carried in a thin layer on the surface of the developing roller 13 by the developing blade 15. By applying a developing bias to the developing roller 13, the developer is supplied depending on the latent image and thus the latent image is developed into a developer image. This (developer) image is transferred onto the fed sheet S by bias voltage application to a transfer roller 9. The sheet S is conveyed to a fixing device 10, in which the image is fixed on the sheet S and then the sheet S is discharged by a sheet discharging region 1 to a sheet discharge portion 3 at an upper portion of the image forming apparatus.

<Summary of Constitution of Developer Accommodating unit>

Next, a constitution of a developer accommodating unit 25 will be described with reference to FIGS. 4 and 7. Here, FIG. 4 is a sectional view of the developer accommodating unit 25 before unsealing, and FIG. 5 is a cut-away perspective view of the developer accommodating container 26.

(Developer Accommodating Unit)

Figure 4:
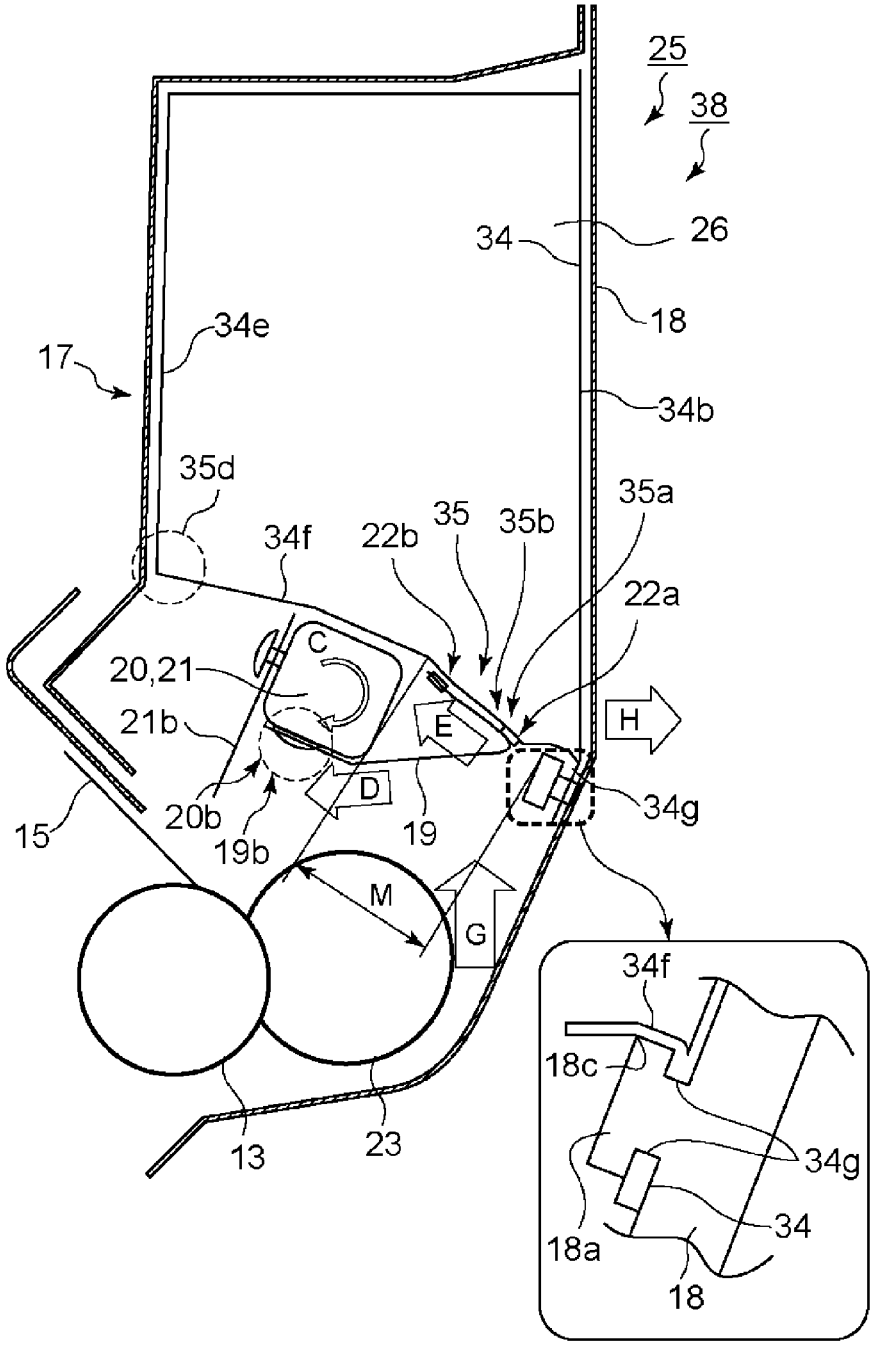
FIG. 4 is a sectional view of the developer accommodating unit in the embodiment of the present invention.
Figure 5:
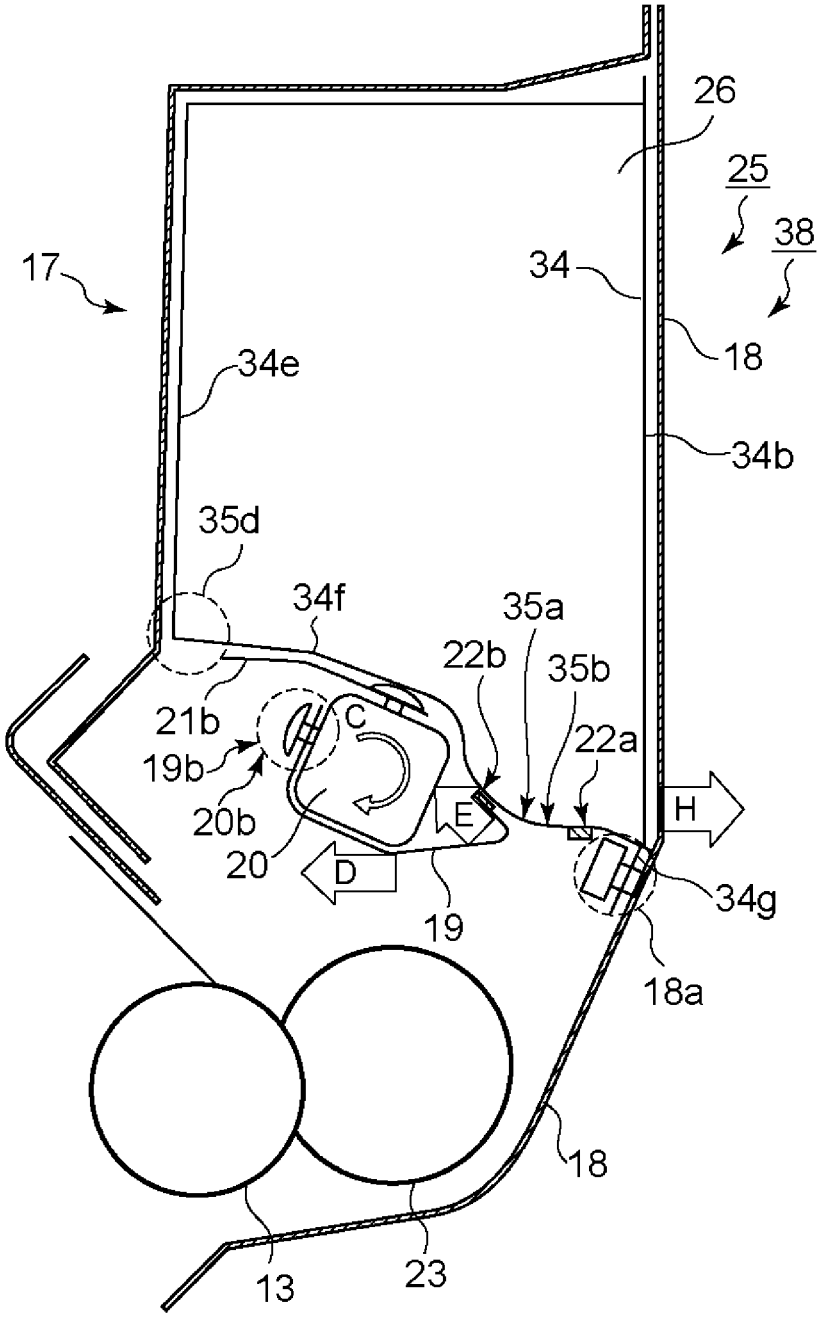
FIG. 5 is a sectional view of the developer accommodating unit in the embodiment of the present invention.

The developer accommodating unit 25 is constituted, as shown in FIG. 4, by the developer accommodating container 26, the developing roller 13, the developing blade 15, and the first frame 17 and the second frame 18 which support these members. A combination of the first frame 17 and the second frame 18 constitute a frame for accommodating the developer accommodating container 26.

Incidentally, in this embodiment, the developer accommodating unit 25 is the same as the developing device 38. This is because the developer accommodating unit 25 includes the developing roller 13 and the developing blade 15. However, by supporting the developing roller 13 and the developing blade 15 by a frame which is separate from the developer accommodating unit 25, the developing roller 13 and the developing blade 15 may also be separated from the developer accommodating unit 25. In this case, the developing device 38 is constituted by the developer accommodating unit 25, the developing roller 13 and the developing blade 15 (not shown).

(Developer Accommodating Container)

A constitution of the developer accommodating container will be described with reference to FIGS. 4 and 7.

Figure 7:
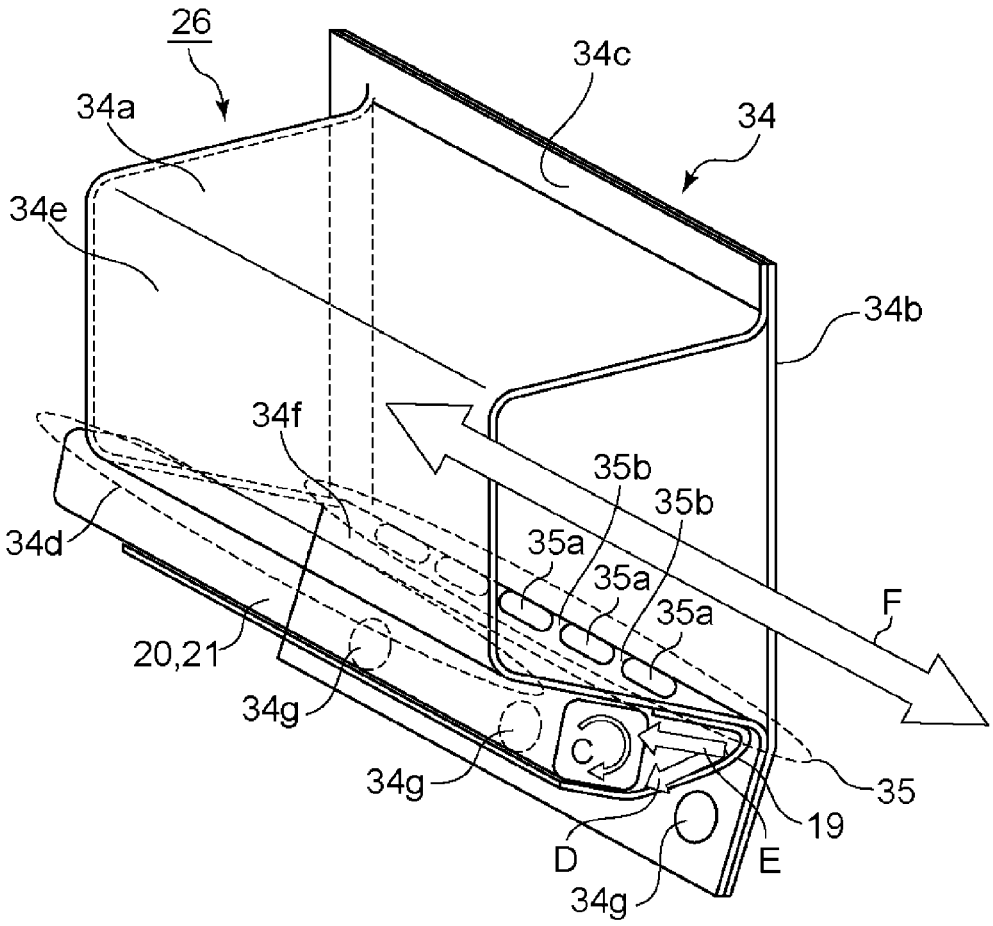
FIG. 7 is a perspective view of a developer accommodating container in the embodiment of the present invention.

As shown in FIG. 7, the developer accommodating container 26 includes the developer accommodating member 34 and the sealing member 19 and the unsealing member 20. The developer accommodating member 34 is a flexible container in which a powdery developer is accommodatable. The developer accommodating member 34 is constituted by a molded portion 34*a* formed by subjecting a sheet-like material to vacuum molding, compressed-air molding or press molding, and a sheet-like air-permeable portion 34*b* having an air permeability. Here, as a bonding method between the molded portion 34*a* and the air-permeable portion 34*b*, there are (thermal) welding, laser welding, an adhesive (bonding), an adhesive tape (bonding), and the like. At an outer peripheral portion 34*c* of the developer accommodating member 34, fixing portions 34*g* (portions-to-be-fixed) of the developer accommodating member 34 are partly provided. Further, the developer accommodating member 34 includes a discharging portion 35 which is openings for permitting discharge of the developer. From the process cartridge A before use, in order to seal the developer from the developer accommodating member 34, the sealing member 19 is bonded to the developer accommodating member 34 so as to cover the discharging portion 35. The sealing member 19 is a sheet-like member having flexibility, and is peeled (pulled) off from the developer accommodating member 34 to expose the discharging portion 35, so that the developer can be made dischargeable from the developer accommodating container 26. Further, the sealing member 19 is connected with an unsealing member 20 at a portion-to-be-engaged 19*b*, and the unsealing member 20 is rotatably supported by the second frame 18. To the unsealing member 20, by an unshown driving means provided in the image forming apparatus main assembly B, a driving force is transmitted, and thus the unsealing member 20 is rotated in an arrow C direction, so that it is possible to wind up the sealing member 19 to expose the discharging portion 35.

Further, as shown in FIG. 4, the developer accommodating container 26 is fixed by the portions-to-be-fixed 34g in an inside space formed by the first frame 17 and the second frame 18. Here, the discharging portion 35 may preferably be configured so that the accommodated developer is easily discharged in its attitude during image formation. For that reason, in the attitude during the image formation, the discharging portion 35 is disposed so as to be directed downward with respect to the vertical direction.

(Detailed Constitution of Discharging Portion)

Figure 8:
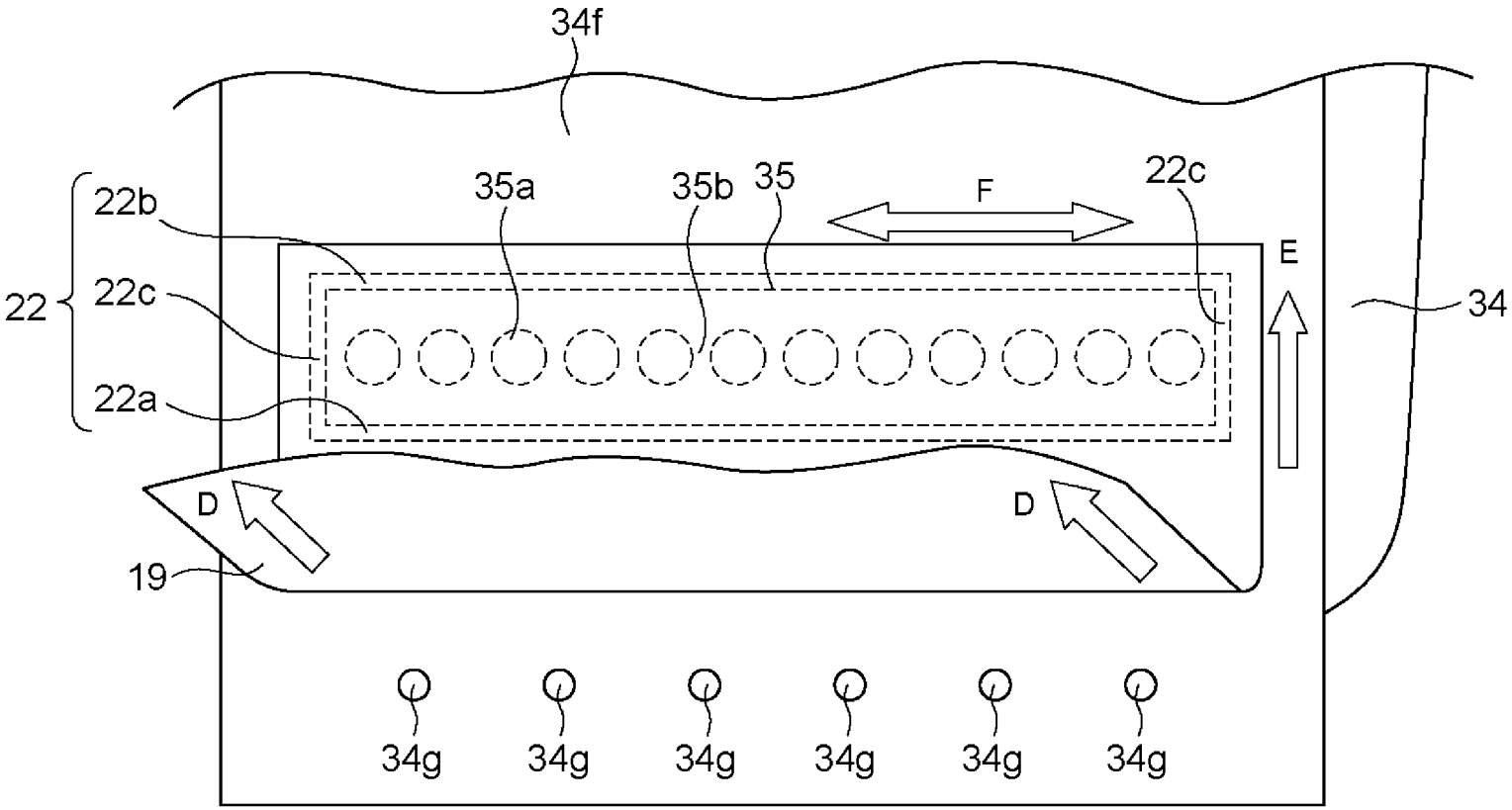
FIG. 8 includes detailed illustrations at a periphery of a discharging portion in the embodiment of the present invention.

Next, details of the discharging portion 35 will be described with reference to FIG. 8. Here, FIG. 8 is a detailed illustration at a periphery of the discharging portion 35 provided to the developer accommodating member 34. A state in which the sealing member 19 is bonded onto the developer accommodating member 34 is shown. The sealing member 19 seals openings 35a and exposes the openings 35a by movement. A movement direction (in which the sealing member 19 is pulled by the unsealing member 20) of the sealing member 19 is a direction D. By the movement of the sealing member 19, the exposure of the openings 35a in an unsealing direction E advances. As shown in FIG. 8, the discharging portion 35 is constituted by a plurality of the openings 35a for permitting discharge of the inside developer, and a connection portions 35b which defines the plurality of openings 35a. The openings 35a and the connection portion 35b are disposed in a direction F perpendicular to the unsealing direction E.

Here, each of the plurality of openings 35a in Embodiment 1 has a round shape. Further, the discharging portion 35 is, by the sealing member 19, continuously surrounded by a bonding portion 22 of the sealing member 19, which is unsealably connected at a periphery of the discharging portion 35 to seal the developer accommodated in the developer accommodating member 34.

Here, as shown in FIG. 8, the connecting portion 22 enables the sealing of the discharging portion 35 by being shaped in a rectangular shape which continuously surrounds two lines with respect to a long direction (direction F) and two lines with respect to a short direction (direction E). Of the two lines of the connecting portions 22 welded with respect to the long direction (direction F), an early unsealed line is referred to as a first bonding portion 22a and a late unsealed line is referred to as a second bonding portion 22b. Here, the bonding portion 22 which opposes the first bonding portion 22a via the openings 35a is the second bonding portion 22b. Further, the bonding portion 22 with respect to the short direction is referred to as a widthwise (short-side) bonding portion 22c. In this embodiment, the unsealing direction is the direction E. The unsealing direction is defined as follows. In the case where the unsealing is performed by moving the sealing member 19, of the first bonding portion 22a and the second bonding portion 22b between which the openings 35a are interposed, the first bonding portion 22a is unsealed first (peeled).

(Fixing Between Developer Accommodating Member and Second Frame)

Next, fixing between the developer accommodating member 34 and the second frame 18 will be described with reference to FIGS. 4 and 7. As shown in FIG. 4, the developer accommodating member 34 is fixed inside the second frame 18 by the fixing portions 34g. As shown in FIG. 7, the plurality of the fixing portions 34g are provided in parallel to the direction F in which the plurality of openings 35a are disposed, and receive a force when the sealing member 19 is unsealed from the developer accommodating member 34. Incidentally, the develops 34g may also be a single fixing portion, other than the plurality of the fixing portions 34g, which is long in parallel to the direction F.

Further, the fixing portions 34g of the developer accommodating member 34 are fixed on a fixing portion 18a of the second frame 18. As a fixing means, other than ultrasonic caulking, it is also possible to use means other than those using ultrasonic wave. For example, the fixing means may also be thermal caulking using heat, thermal welding or ultrasonic welding which effect direct welding between the developer accommodating member 34 and the second frame 18, bonding using a solvent or an adhesive, clamping between the frames, thermal caulking, ultrasonic caulking, screw, hooking using a hole and a projected portion (boss or the like), etc. In the case of the bonding, a region where the developer accommodating member 34 and the second frame 18 are bonded is the fixing portion. Also with respect to the clamping, the thermal caulking, the ultrasonic caulking, the screw, the boss and the like, a region where the clamping is made, a region where the thermal caulking (the ultrasonic caulking) is effected, a region where there is the screw, the boss or the like are the fixing portion.

Incidentally, as shown in FIG. 4, in order to peel the second bonding portion 22b of the developer accommodating member 34 with reliability, it is preferable that the following arrangement relationship is established between the second bonding portion 22b of the developer accommodating member 34 and the fixing portion 18a of the second frame 18. That is, with respect to the movement direction D of the sealing member 19 by the unsealing member 20, the frame 18a of the second frame 18 and the unsealing member 20 may preferably be provided so as to sandwich the discharging portion 35. The sealing member 19 is pulled, with respect to the fixing portion 18a of the second frame 18, in the direction of the arrow D by the unsealing member 20 during unsealing. Here, the fixing portions 34g of the developer accommodating member 34 are fixed by the fixing portion 18a of the second frame 18. For that reason, the sealing member 19 is pulled, in the directions of an arrow H and the arrow D, between the fixing portion 18a of the second frame 18 and the unsealing member 20. As a result, a force is applied to the first bonding portion 22a of the developer accommodating member 34, so that the sealing member 19 is peeled in the arrow E direction. Therefore, the discharging portion 35 may preferably be provided so as to be sandwiched in a range of a region M by the unsealing member 20 and the fixing portion 18a of the second frame 18.

Figure 6:
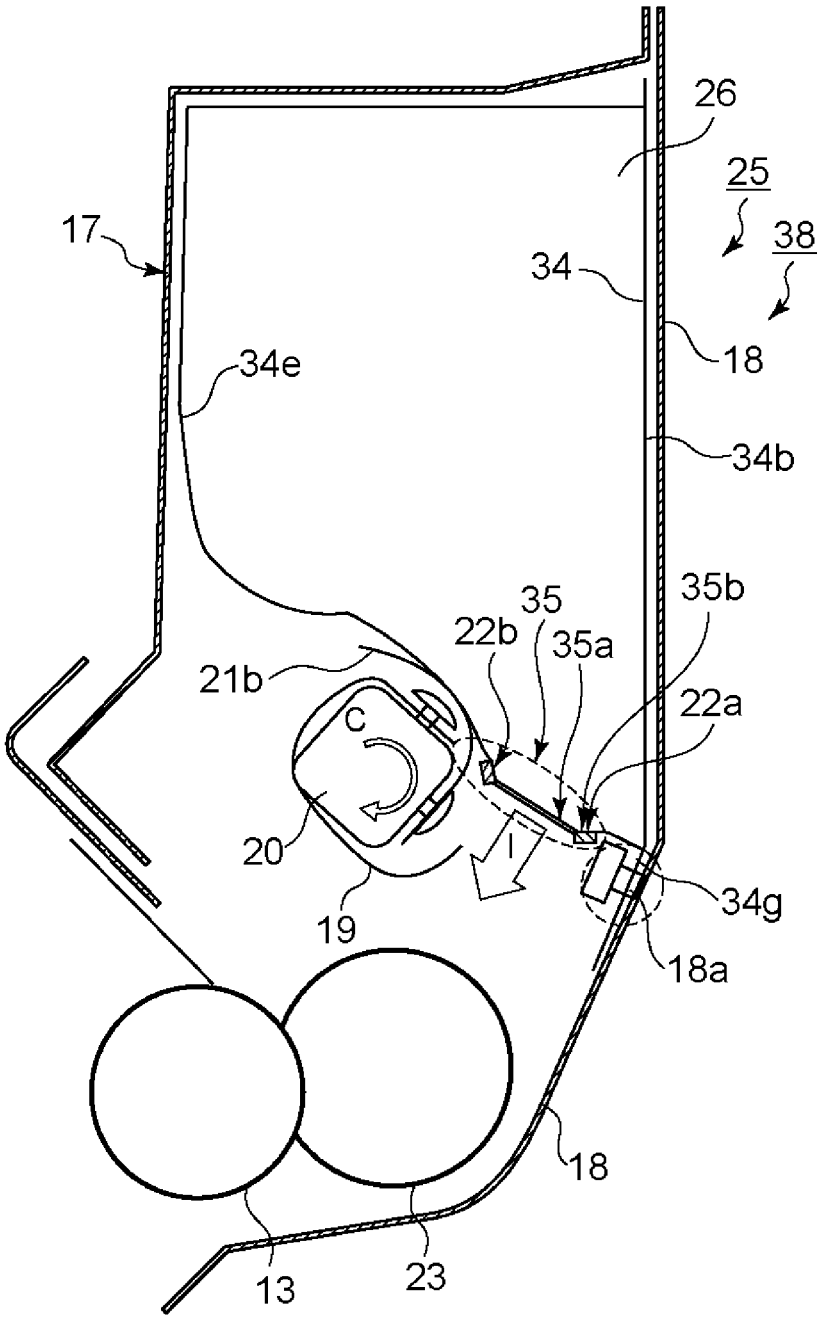
FIG. 6 is a sectional view of the developer accommodating unit in the embodiment of the present invention.

In the following, with respect to an arrangement relationships between the connecting portion 35b of the discharging portion 35 according to the present invention and the fixing portions 34g of the developer accommodating member 34, description will be made in detail by using FIG. 1, FIG. 5 and FIG. 6.

(Function of Connecting Portion an Arrangement Relationship of Connecting Portion with Fixing Portions of Developer Accommodating Member)

Here, in an unsealing operation of the developer accommodating member 34, a relationship among the openings 35 and the connecting portion 35b of the developer accommodating member 34 and the fixing portions 34g of the developer accommodating member 34 will be described.

Figure 1:
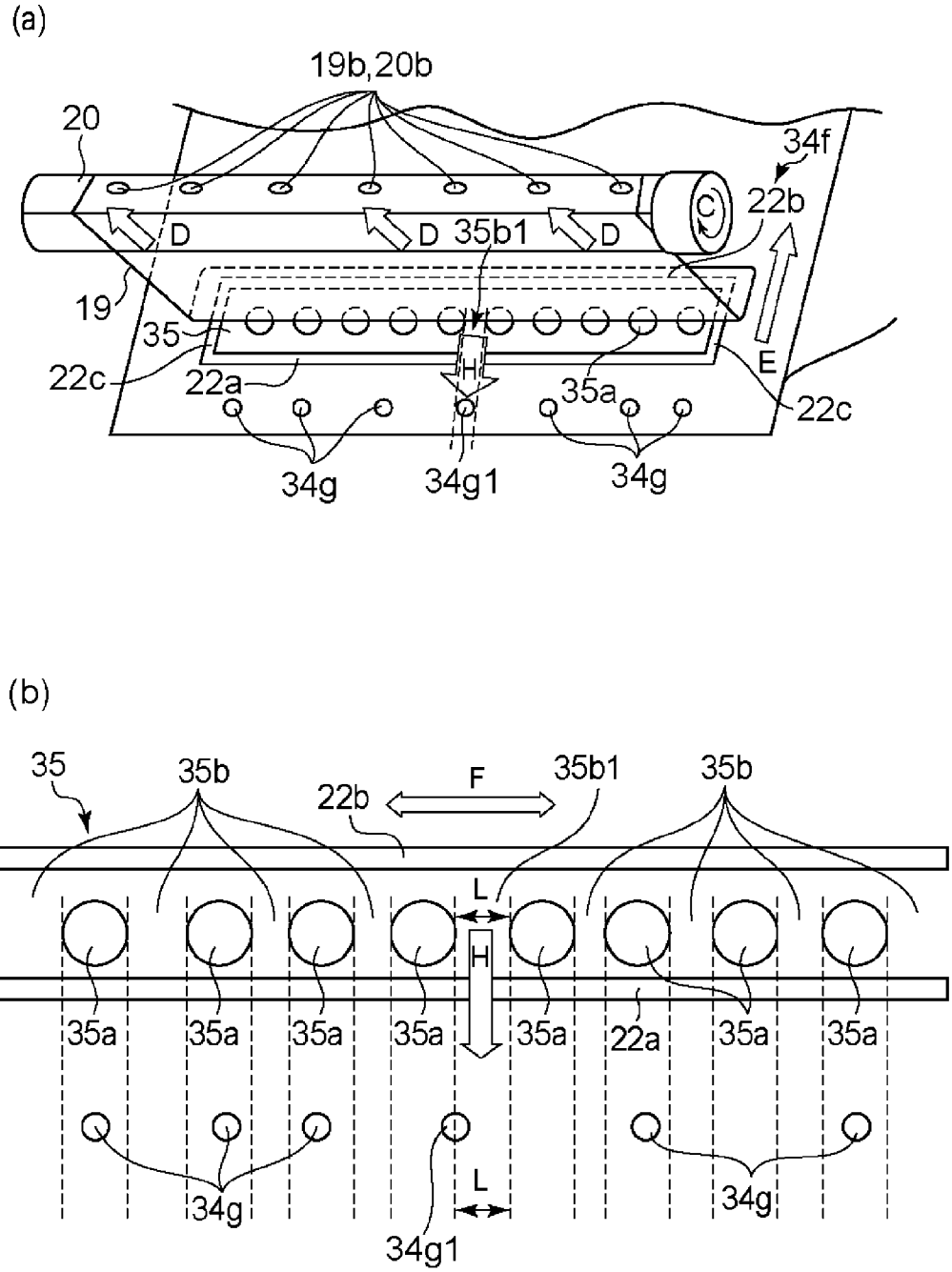
FIG. 1 includes illustrations of a developer accommodating unit in an embodiment of the present invention.

FIG. 1 includes discharging portion illustrations at a periphery of the discharging portion 35 when peeling of the portion which is the first bonding portion 22a to be first unsealed is ended and the openings 35a are exposed, and shows a state in which the peeling of the second bonding portion 22*b* of the developer accommodating member 34 is not complete. Further, FIG. 5 is a sectional view of the developer accommodating unit 25 in a state in which the peeling of the second bonding portion 22*b* of the developer accommodating member 34 is not complete after the first bonding portion 22*a* is peeled. Further, FIG. 6 is a sectional view of the developer accommodating unit 25 after the second bonding portion 22*b* is peeled. As shown in FIG. 1, the discharging portion 35 includes the plurality of the openings 35*a* with respect to the perpendicular direction F to the unsealing direction E in which the exposure of the openings 35*a* advances. For that reason, also the plurality of the connecting portions 35*b* are disposed at a plurality of positions with respect to the F direction.

A relationship between the connecting portions 35*b* and the above-described fixing portions 34*g* of the developer accommodating member 34 is as follows. As shown in FIG. 1, of the connecting portions 35*b* located in the neighborhood of the discharging portion 35 with respect to the F direction, one connecting portion 35*b*1 and a fixing portion 34*g*1 of the developer accommodating member 34 are disposed so as to overlap with each other at least partly in a range of a region L of the connecting portion 35*b*1 with respect to the unsealing direction E. That is, in the unsealing direction E, the fixing portion 34*g*1 and the connecting portion 35*b*1 are disposed so as to overlap with each other.

When viewed from the unsealing direction E, at least a part of one fixing portion 34*g*1 is located in the range of the region L of one connecting portion 35*d*1, so that the connecting portion 35*b*1 performs a function of connecting the fixing portion 34*g*1 of the developer accommodating member 34 with the second boding portion 22*b* of the developer accommodating member 34. For that reason, it becomes possible that an unsealing force of the second boding portion 22*b* of the developer accommodating member 34 via the connecting portion 35*b* is received by the fixing portion 34*g*1 of the developer accommodating member 34. As a result, the connecting portion 35*b*1 can transmit a force, for peeling the sealing member 19 from the developer accommodating member 34, to the fixing portion 34*g*1 of the developer accommodating member 34. Therefore, the sealing member 19 is peelable also at the second boding portion 22*b*.

Figure 9:
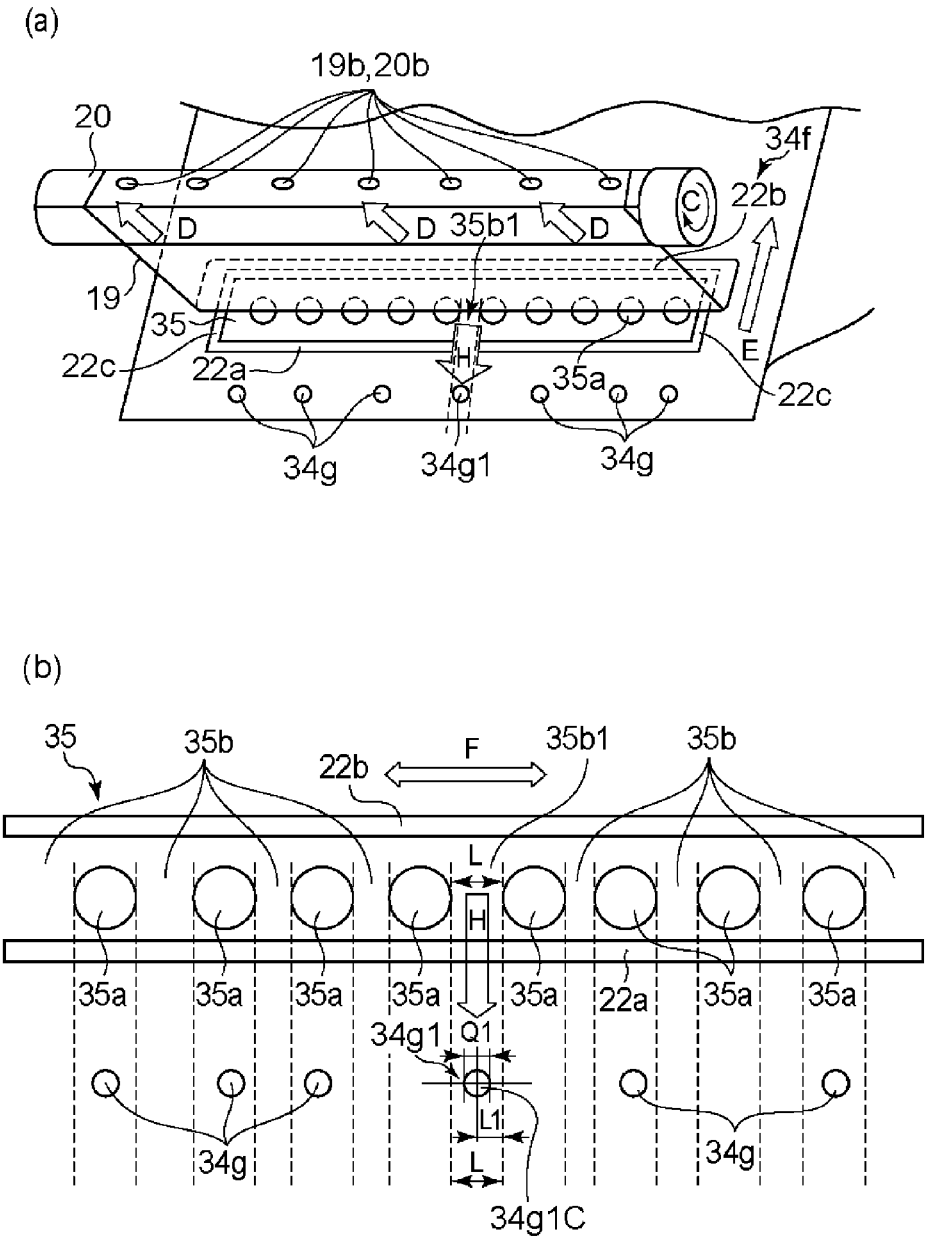
FIG. 9 includes detailed illustrations showing another positional relation at the periphery of the discharging portion in the embodiment of the present invention.

Next, with respect to the positional relationship between the fixing portion 34*g*1 of the developer accommodating member 34 and the connecting portion 35*b*1, another constitution is shown in FIG. 9. FIG. 9 includes detailed illustrations at a periphery of the discharging portion immediately before the second boding portion 22*b* is peeled. In FIG. 9, the fixing portion 34*g*1 of the developer accommodating member 34 is, with respect to the unsealing direction E, disposed with a relation L1=L/2 such that a center portion 34*g*1C of the fixing portion 34*g*1 is located at a central portion of the range of the region L of the connecting portion 35*b*1. That is, in the unsealing direction E of the sealing member, the center of the fixing portion 34*g*1 and the connecting portion 35*b*1 are disposed so as to overlap with each other. For that matter, in the unsealing direction E of the sealing member, the center of the fixing portion 34*g*1 and the central portion of the connecting portion 35*b*1 are disposed so as to overlap with each other.

Here, the force when the second boding portion 22*b* is unsealed is received by the fixing portions 34*g* of the developer accommodating member 34 via the connecting portions 35*b*, but a portion actually receiving the force is a range of a width Q1 where the force is exerted on the fixing portion 34*g* of the developer accommodating member 34. When the second boding portion 22*b* is unsealed, the openings 35*a* and the connecting portions 35*b* at the periphery of the openings 35*a* are not a little deformed. Here, the central portion 34*g*1*c* of the fixing portion 34*g*1 which is the central portion of the range of the width Q1 in which the fixing portion 34*g*1 receives the force is disposed so as to be located at the central portion of the region L of the connecting portion 35*b*1. By employing such a constitution, even when the deformation of the openings 35*a* and the connecting portions 35*b* at the periphery of the openings 35*a* generates, in the unsealing direction E, the center of the fixing portion 34*g*1 and the connecting portion 35*b*1 can overlap with each other. When a constitution in which the part of the fixing portions such as the fixing portion 34*g*1 of (b) of FIG. 1 and the opening 35*a* is employed, there is a fear that the overlap is eliminated by the deformation in the neighborhood of the opening 35*a*.

By employing such a constitution, the force for unsealing the second boding portion 22*b* of the developer accommodating member 34 can be received by the fixing portion 34*g*1 of the developer accommodating member 34 via the connecting portion 35*b*, so that the sealing member 19 can be peeled. Such a constitution is effective in the case where the width Q1 of the fixing portion 34*g* of the developer accommodating member 34 is narrow particularly with respect to the region L of the connecting portion 35*b*1.

Figure 10:
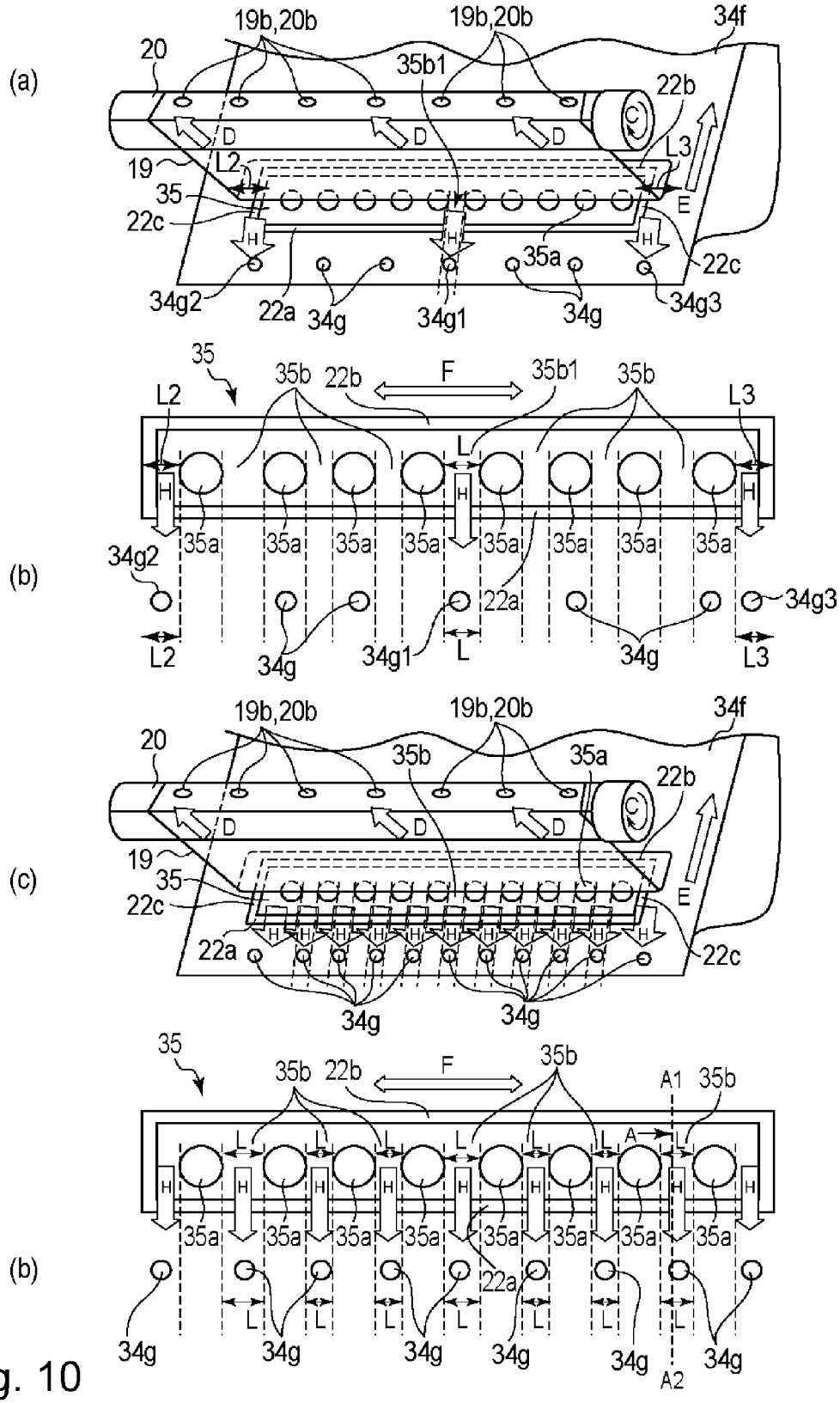
FIG. 10 includes detailed illustrations of another constitution in the embodiment of the present invention.

Further, another constitution of the plurality of the openings 35*a*, the connecting portions 35*b* and the fixing portions 34*g* of the developer accommodating member 34 is shown in FIG. 10. FIG. 10 includes detailed illustrations at the periphery of the discharging portion immediately before the second boding portion 22*b* is peeled.

First, as shown in (a) of FIG. 10 and (b) of FIG. 10, in addition to the fixing portion 34*g*1 of the developer accommodating member 34 of FIG. 1, fixing portions 34*g*2 and 34*g*3 of the developer accommodating member 34 are disposed in a region between the opening 35*a* and the widthwise (short) boding portion 22*c* at both ends of the discharging portion 35*a* with respect to the F direction. In a range of a region L2 between the opening 35*a* and the widthwise boding portion 22*c* at the end of the discharging portion 35 with respect to the F direction, the fixing portion 34*g*2 of the developer accommodating member 34 is disposed, and similarly in the range of L3, the fixing portion 34*g*3 of the developer accommodating member 34 is disposed. By this, also in the neighborhood of the both ends of the discharging portion 35 with respect to the F direction, the fixing portions 34*g*2 and 34*g*3 of the developer accommodating member 34 and the second boding portion 22*b* of the developer accommodating member 34 are connected via the developer accommodating member 34.

In the direction F perpendicular to the unsealing direction E of the sealing member 19, a region sandwiched between the extreme end opening 35*a* of the plurality of the openings 35*a* and the widthwise boding portion 22*c* is an end portion connecting portion L2 (L3). Further, in the unsealing direction E, the fixing portion 34*g*2 (34*g*3) and the end portion connecting portion L2 (L3) are disposed so as to overlap with each other.

In order to unseal the sealing member 19 more reliably, it is important that forces, during peeling, at a portion as a trigger for the second boding portion 22*b* of the developer accommodating member 34 to be unsealed and at a portion to be finally peeled are received by the fixing portions 34*g* of the developer accommodating member 34.

Here, when the force at the time of unsealing the second boding portion 22*b* of the developer accommodating member 34 is applied to the unsealing member 20, the unsealing member 20 is pulled by the sealing member 19 in an opposite direction to the direction D shown in (a) of FIG. 10. For that reason, the unsealing member 20 supported at its both ends by the second frame 18 not a little generate flexure (bending) with respect to the opposite direction to the direction D. At this time, a flexure amount of the unsealing member 20 is, in the F direction shown in (a) of FIG. 10, smallest in the neighborhood of the both ends close to the portions where the unsealing member 20 is supported, and is largest in the neighborhood of the center remote from the portions where the unsealing member 20 is supported. Further, with a larger degree of the flexure of the unsealing member 20, timing of the unsealing of the sealing member 19 by the unsealing member 20 becomes later. By the flexure of the unsealing member 20, a distance between the unsealing member 20 and the first boding portion 22*a* becomes near. For that reason, the sealing member 19 between the unsealing member 20 and the first boding portion 22*a* sags to have allowance, and this is because at the outset of start of winding-up by the unsealing member, only the sagging portion of the sealing member 19 is wound up. Therefore, with respect to the peeling of the second boding portion 22*b* of the developer accommodating member 34, the portions in the neighborhood of the both ends of the unsealing member 20 where the sagging is small are early wound up to act as a trigger for the peeling, and the portion in the neighborhood of the central portion of the unsealing member 20 where the sagging is large is finally peeled. Here, in the neighborhood of the end portion acting as the trigger for the peeling, when the developer accommodating member 34 is largely deformed, the developer accommodating member 34 winds around the unsealing member 20, so that there is a fear that the unsealing does not start in the first place. Further, in a first stage in which the peeling starts, the force for the unsealing becomes large, and therefore when a shearing peeling state described later is formed by the deformation of the developer accommodating member 34, a larger force is needed. Therefore, the fixing portions 34*g*2 and 34*g*3 of the developer accommodating member 34 are provided, with respect to the unsealing direction E, in the ranges of the regions L2 and L3 between the opening 35*a* and the widthwise boding portion 22*c* at the both ends of the discharging portion 35 with respect to the F direction. Further, when the peeling advances and the unsealing advances to the neighborhood of the central portion with respect to the F direction, the deformation of the developer accommodating member 34 becomes large. This is because all the portions bonded in regions other than the central portion are peeled, and therefore a peeling force for the developer accommodating member 34 concentrates at the center portion. When the developer accommodating member 34 is largely deformed, a problem such as wind-up around the unsealing member 20 similarly occurs. Therefore, the fixing portion 34*g*1 is disposed, with respect to the unsealing direction E, in the range of region L of the connecting portion 35*b*1 with respect to the direction F in the neighborhood of the central portion of the discharging portion 35 with respect to the direction F. By employing such as a constitution, the sealing member 19 can be peeled with reliability. In this embodiment, at the central portion of the second boding portion 22*b* in the direction F perpendicular to the unsealing direction E, the connecting portion 35*b*1 and the fixing portion 34*g*1 are disposed so as to overlap with each other.

Next, another constitution of the plurality of the openings 35*a*, the connecting portions 35*b* and the fixing portions 34*g* of the developer accommodating member 34 is shown in (c) of FIG. 10 and (d) of FIG. 10. In (c) of FIG. 10 and (d) of FIG. 10, a constitution in which all of the plurality of the fixing portions 34*g* of the developer accommodating member 34 are disposed, with respect to the range of the region L of the connecting portion 35*b* with respect to the unsealing direction E in which the exposure of the openings 35*a* advances is shown. By disposing all the fixing portions 34*g* of the developer accommodating member 34 in the range of the region L of the connecting portion 35*b* with respect to the direction F, the force for unsealing the second bonding portion 22*b* of the developer accommodating member 34 can be received by the fixing portions 34*g* of the developer accommodating member 34. For that reason, the sealing member 19 can be peeled more reliably.

Figure 14:
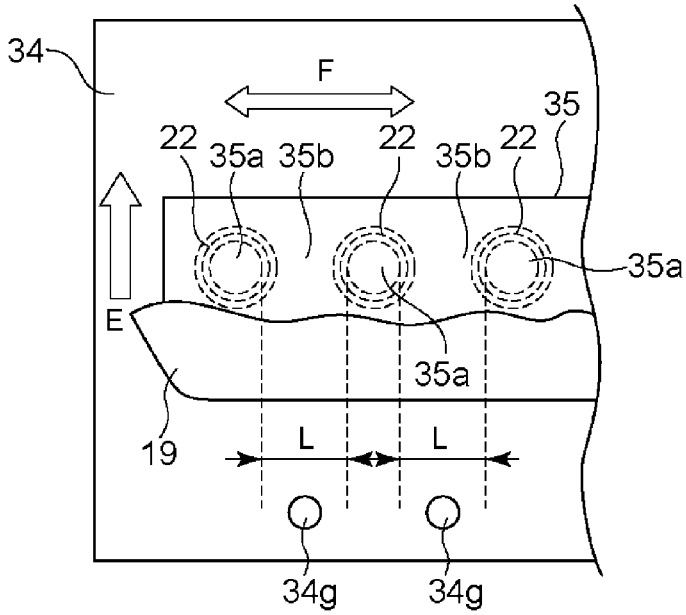
FIG. 14 includes detailed illustrations of another boding portion constitution in the embodiment of the present invention.
Figure 14:
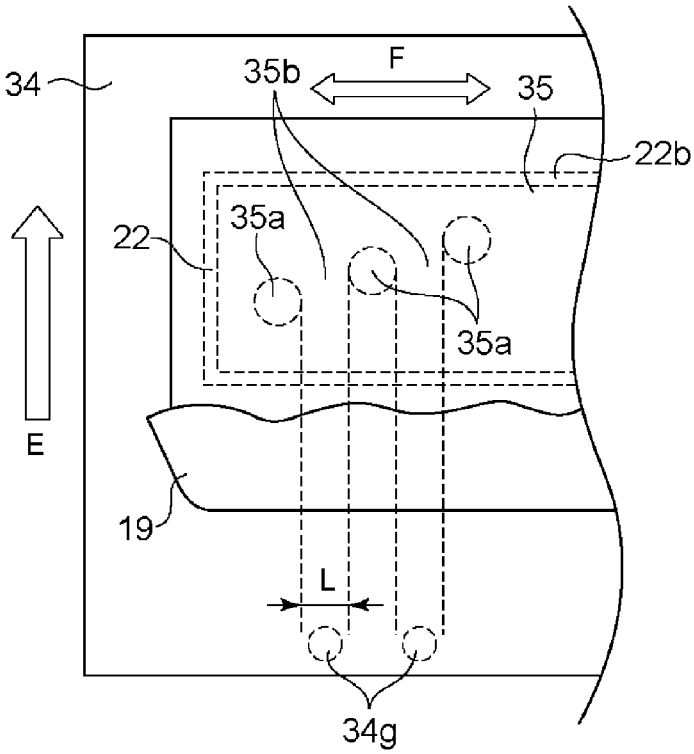
Figure 15:
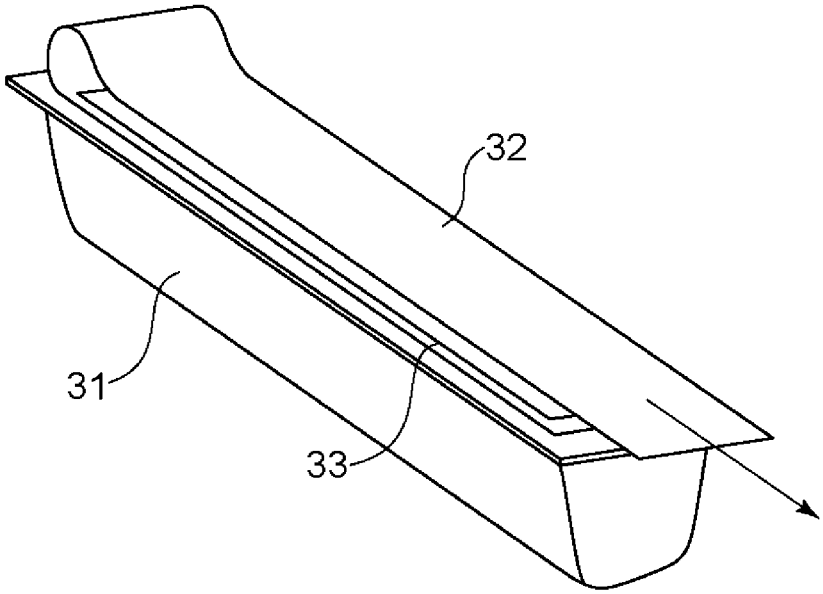
FIG. 15 is a perspective view of a conventional deformable container.

Further, (a) of FIG. 14 is an illustration, at the periphery of the discharging portion 35, showing a bonding pattern of the bonding portions 22 where the openings 35*a* are unsealed with the sealing member 19. Further, (b) of FIG. 14 is an illustration, at the periphery of the discharging portion 35, showing an arrangement constitution of the openings 35*a*. Also in addition to the above-described constitution in which the periphery of the openings 35*a* is continuously surrounded by the bonding portion 22 in the rectangular shape, the following constitutions may also be employed. The present invention is applied also in a constitution in which the sealing member 19 and the developer accommodating member 34 are connected by connecting portions 22 each surrounding an opening 35*a* as shown in (a) of FIG. 14, and in a constitution in which openings 35*a* are not completely arranged in a direction perpendicular to the unsealing direction E in a region of the connecting portion 22. Also in this case, as seen from the unsealing direction E, the fixing portions 34*g* of the developer accommodating member 34 are located in the range of the region L of the connecting portions 35*d*, so that the force for unsealing the bonding portion(s) 22 of the developer accommodating member 34 can be received by the fixing portions 34*g* of the developer accommodating member 34 via the connecting portions 35. As a result, the connecting portions 35*b* can transmit the force, for peeling the sealing member 19 from the developer accommodating member 34, to the fixing portions 34*g* of the developer accommodating member 34. As a result, the sealing member 19 is peelable also at the bonding portion 22.

That is, when the plurality of the openings 35*a* are disposed at certain intervals with respect to the direction F perpendicular to the unsealing direction E, the connecting portions 25 are present, so that the fixing portion 34*g* of the developer accommodating member 34 can be disposed in the range of the region L of the connecting portion 35*b* with respect to the unsealing direction E in which the exposure of the opening 35*a* advances.

Figure 13:
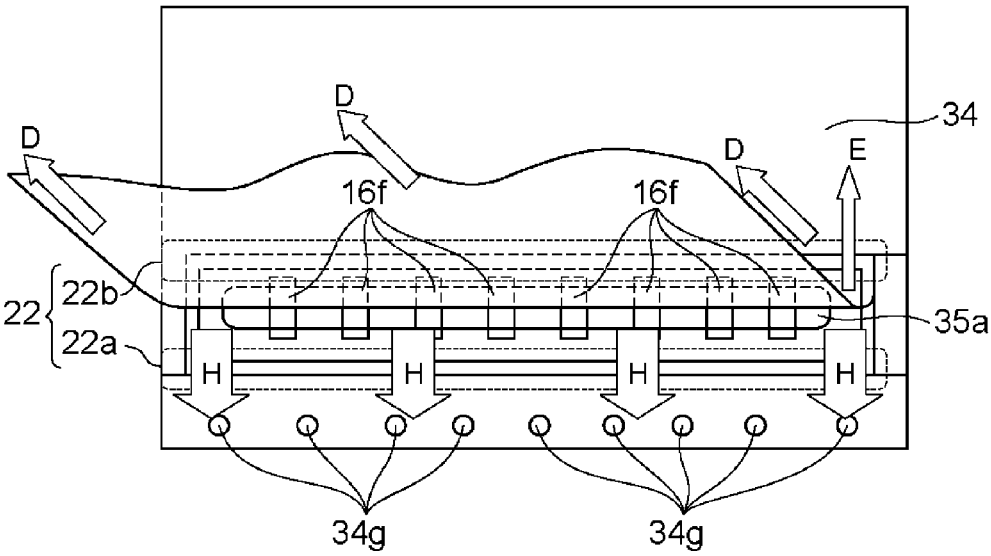
FIG. 13 includes detailed illustrations at a periphery of a connecting and discharging portion in the embodiment of the present invention.
Figure 13:
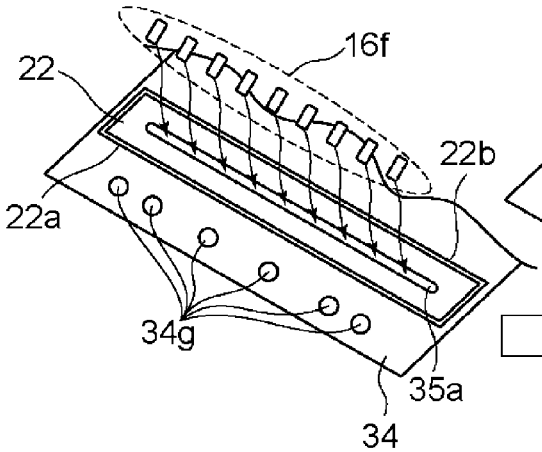
Figure 13:
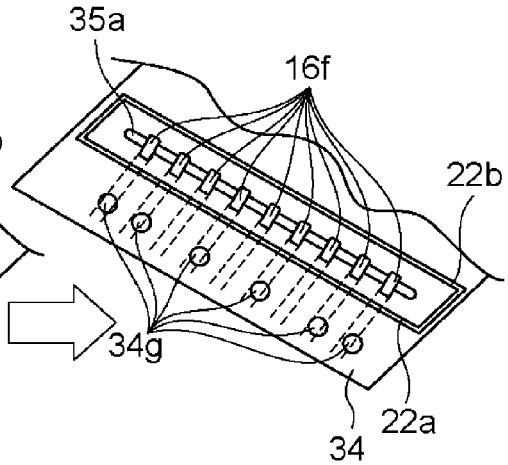

Further, the connecting portions 35*b* may also be constituted by a separate member. FIG. 13 includes illustrations in which the discharging portion 35 is constituted by connecting members 16*f*, as the connecting portions, which are the separate member. Part (a) of FIG. 13 is the illustration at the periphery of the discharging portion 35 constituted by the connecting members 16*f*, as the connecting portions 35*b*, which are the separate member, and (b) of FIG. 13 is an enlarged with thereof. As shown in (b) of FIG. 13, a single opening 35*a* long with respect to the direction F perpendicular to the unsealing direction E is provided, and at the long single opening 35*a*, along the unsealing direction E, the connecting members 16*f* which are the separate member for connecting the fixing portions 34*g* of the developer accommodating member 34 with the second bonding portion 22*b* of the developer accommodating member 34 are provided. At this time, the connecting members 16*f* are bonded, by bonding, welding or the like, in each of the first bonding portion 22*a* side and the second bonding portion 22*b* side of the long single opening 35*a*. Also in such a constitution, similarly as the connecting portions 35*b*, the force for unsealing the bonding portion 22 of the developer accommodating member 34 can be received by the fixing portions 34*g* of the developer accommodating member 34 via the connecting members 16*f*, and therefore it becomes possible to perform the peeling of the sealing member 19 with reliability. As a result, an unsealing characteristic can be improved.

(Problem in Case where the Present Invention is not Applied)

Figure 11:
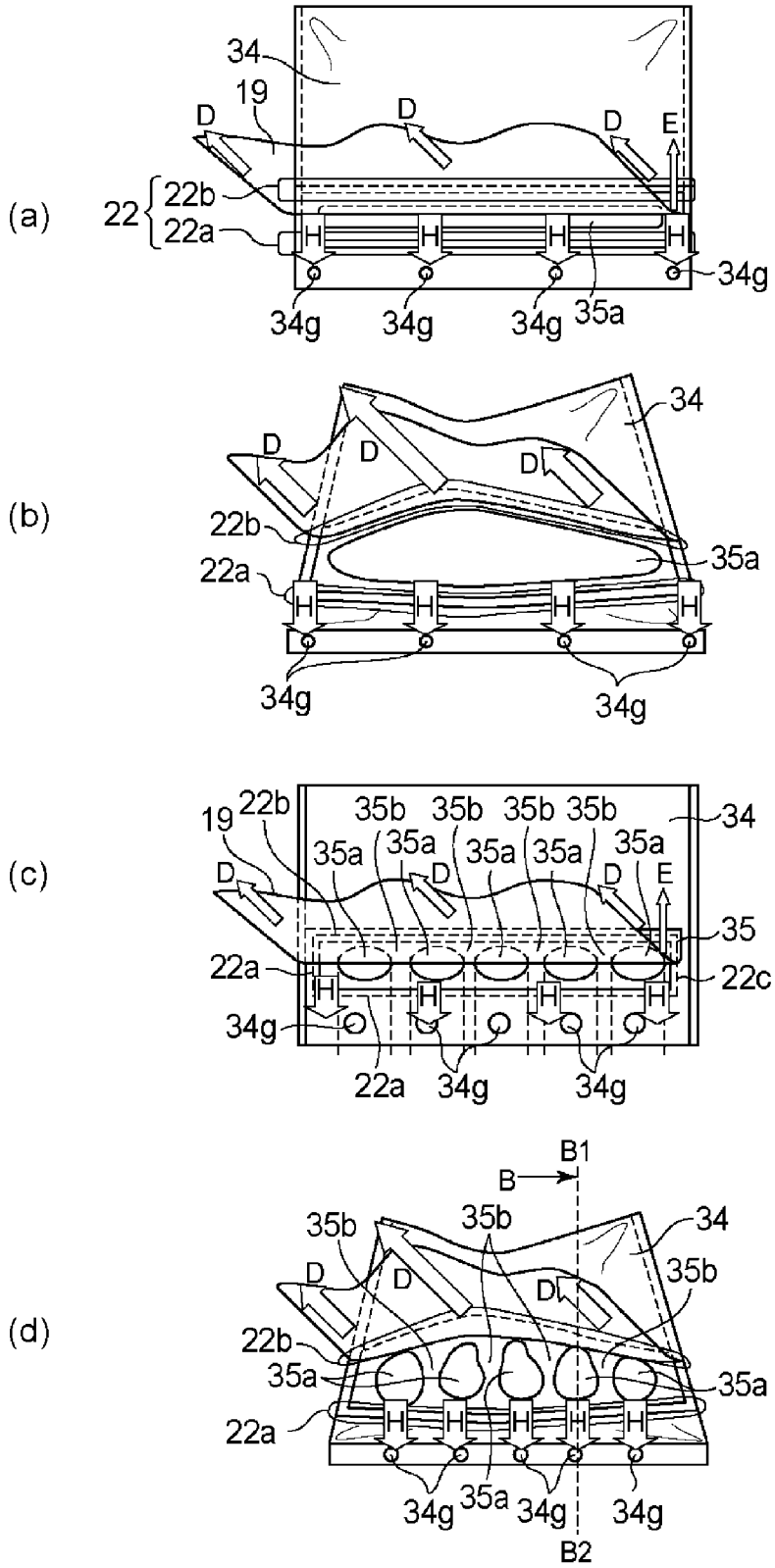
FIG. 11 includes detailed illustrations of another constitution which is not employed in the embodiment of the present invention.

Next, an example in which the present invention is not applied and it is difficult to unseal the developer accommodating member 34 will be described by using FIG. 11 and FIG. 12. Part (a) of FIG. 11 and (b) of FIG. 11 are illustrations in the case where the connecting portions 35*b* are not provided. Further, (c) of FIG. 11 and (d) of FIG. 11 are illustrations in the case where the fixing portions 34*g* of the developer accommodating member 34 are not disposed in ranges of regions of the connecting portions 35*b* with respect to the unsealing direction E in which the exposure of the openings 35*a* advances. Incidentally, (a) of FIG. 11 and (c) of FIG. 11 shows a state before the second bonding portion 22*b* of the developer accommodating member 34 is peeled, and (b) of FIG. 11 and (d) of FIG. 11 are the illustrations of a state in which the second bonding portion 22*b* of the developer accommodating member 34 is being peeled.

In this case, as shown in (a) of FIG. 11 and (c) of FIG. 11, from a state in which the unsealing of the developer accommodating member 34 advances to the second bonding portion 22*b*, the sealing member 19 is pulled and moved in the arrow D direction by further rotation of the unsealing member 20. Then, the second bonding portion 22*b* of the developer accommodating member 34 is free from a force of constraint from the fixing portion 18*a* of the second frame 18, so that the openings 35*a* largely open in the arrow D direction. Further, the second bonding portion 22*b* of the developer accommodating member 34 is pulled by the sealing member 19, so that the opening or openings 35*a* are deformed as shown in (b) of FIG. 11 and (d) of FIG. 11. In this case, a direction of force acting on the second bonding portion 22*b* of the developer accommodating member 34 comes near to the shearing peeling direction. For that reason, a large force is needed for the peeling. Moreover, the fixing portions 34*g* of the developer accommodating member 34 cannot transmit a supporting force to the second bonding portion 22*b* of the developer accommodating member 34, and therefore the second bonding portion 22*b* of the developer accommodating member 34 is pulled by the unsealing member 20 without being peeled. For that reason, the force from the fixing portions 34*g* of the developer accommodating member 34 cannot be transmitted to the second bonding portion 22*b* side of the developer accommodating member 34.

Figure 12:
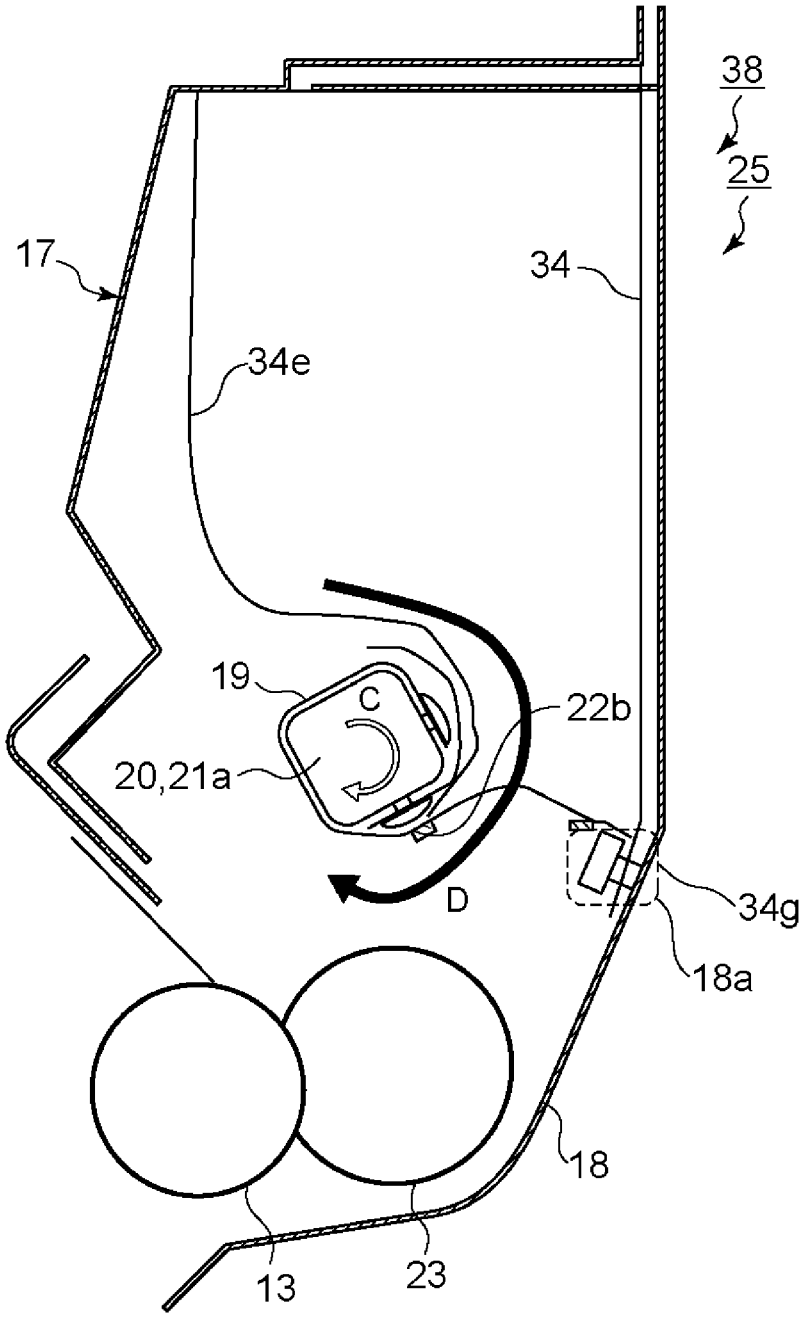
FIG. 12 includes sectional views of a developer accommodating unit which is not employed in the embodiment of the present invention.

Further, as shown in FIG. 12, the opening 35*a* in the neighborhood of the longitudinal central portion of the second bonding portion 22*b* of the developer accommodating member 34 further largely opens, so that the sealing member 19 is wound around the unsealing member 20.

Figure 16:
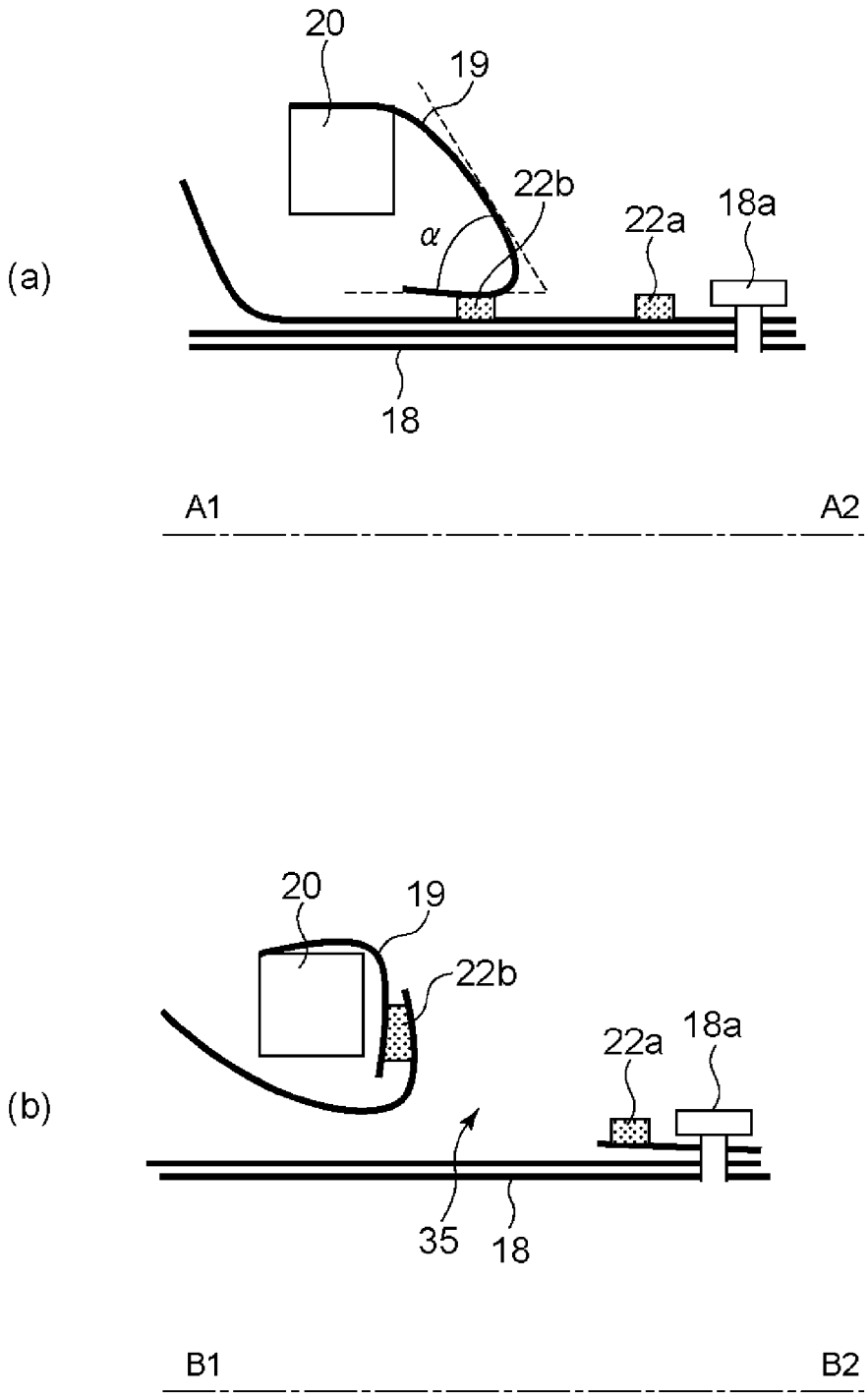
FIG. 16 includes sectional views for illustrating an effect of the present invention.

Description will be made in detail by using FIG. 16. Part (a) of FIG. 16 is an illustration of A1-A2 cross section of (d) of FIG. 10. Part (a) of FIG. 16 is a sectional view of a portion, which is a constitution of the direction, where the fixing portion and the connecting portion overlap with each other in the unsealing direction. Part (b) of FIG. 16 is B1-B2 cross section of (d) of FIG. 10. Part (b) of FIG. 16 is a sectional view of a portion, which is not the constitution of the present invention, where the fixing portion and the connecting portion do not overlap with each other with respect to the unsealing direction. In (a) of FIG. 16 and (b) of FIG. 16, for explanation, the frame 18 is illustrated. In (a) of FIG. 16, when the sealing member 19 is wound up by the unsealing member, the developer accommodating member 34 is hardly deformed. For that reason, in a state in which an angle, to some extent, as an angle α formed between a certain plane of the bonding portion 22*b* of the sealing member 19 and a plane on which the sealing member 19 receives a force from the unsealing member 20 is created, the sealing member is peeled (inclination peeling). On the other hand, in (b) of FIG. 16, when the sealing member 19 is wound up by the unsealing member, the portion in the neighborhood of the opening 35 of the developer accommodating member 34 is deformed, so that the sealing member is peeled in a state in which the angle α is about 0 degrees (shearing peeling). In the case of the shearing peeling, compared with the inclination peeling, the force for the unsealing becomes large, so that there is a fear that the unsealing cannot be made. Further, in the case where deformation of the flexible container is large, there is a fear that the flexible container is wound around the shaft 20.

Incidentally, when a member which accommodates the developer is a hard member such as a structure, there is no such deformation, and the sealing member is unsealable as in the conventional example (constitution). However, in the case of a constitution in which the developer is accommodated in a deformable soft bag-like member and in which the member such that the openings 35*a* are deformed during unsealing is unsealed, there are the connecting portions 35*b*, and it becomes difficult to unseal the member unless the fixing portions 34*g* of the developer accommodating member 34 are disposed in the range of the region of the connecting portions 35*b*.

As described above, the fixing portions 34*g* of the developer accommodating container 34 are disposed in the range of the region of the connecting portions 35*b*, so that the force for peeling the sealing member 19 and the bonding portion 22 of the developer accommodating member 34 can be received by the fixing portions 34*g* of the developer accommodating member 34 via the connecting portions 35*b*. Therefore, the unsealing of the sealing member 19 of the developer accommodating member 34 can be stably effected with reliability.

(Industrial Applicability)

According to the present invention, it is possible to provide a developer accommodating unit using a flexible container and being excellent in unsealing property.

The invention claimed is:

1. A developer accommodating unit for accommodating a developer for image formation, comprising:

a developer accommodating container including a flexible container provided with openings for permitting discharge of the accommodated developer and a sealing member for sealing the openings by a bonding portion and for exposing the openings by being moved;

an unsealing member, mounted on said sealing member, for moving said sealing member;

a frame which accommodates said developer accommodating container and said unsealing member and which includes a fixing portion for fixing said flexible container; and a connecting portion disposed between the openings of the openings in the flexible container, wherein with respect to an unsealing direction of said sealing member, said fixing portion and said connecting portion are provided so as to overlap with each other.

2. A developer accommodating unit according to claim 1, wherein with respect to the unsealing direction of said sealing member, a center of said fixing portion and said connecting portion are provided so as to overlap with each other.

3. A developer accommodating unit according to claim 1, wherein with respect to the unsealing direction of said sealing member, a center of said fixing portion and a central portion of said connecting portion are provided so as to overlap with each other.

4. A developer accommodating unit according to claim 1, wherein at a central portion of the bonding portion with respect to a direction perpendicular to the unsealing direction and in a plane said sealing member, said connecting portion and said fixing portion are provided so as to overlap with each other with respect to the unsealing direction of said sealing member.

5. A developer accommodating unit according to claim 1, wherein a region sandwiched between an extreme end portion of the openings with respect to a direction perpendicular to the unsealing direction of said sealing member and a part of the bonding portion close to said extreme end portion with respect to the direction perpendicular to the unsealing form an end portion connecting portion, and wherein with respect to the unsealing direction of said sealing member, said fixing portion and said end portion connecting portion are provided so as to overlap with each other.

6. A developer accommodating unit according to claim 1, wherein said unsealing member rotates to unseal said sealing member.

7. A developer accommodating unit according to claim 1, wherein said frame houses said developer accommodating container and said unsealing member.

8. A developer accommodating unit for accommodating a developer for image formation, comprising:

a developer accommodating container including a flexible container provided with openings for permitting discharge of the accommodated developer, and including a sealing member for sealing the openings by a bonding portion and for exposing the openings by being moved;

an unsealing member, mounted on said sealing member, for moving said sealing member; and a frame which accommodates said developer accommodating container and said unsealing member and which includes a fixing portion for fixing said flexible container, wherein a region sandwiched between an extreme end portion of the openings with respect to a direction perpendicular to the unsealing direction of said sealing member and a part of the bonding portion close to said extreme end portion with respect to the direction perpendicular to the unsealing direction form an end portion connecting portion, and wherein with respect to the unsealing direction of said sealing member, said fixing portion and said end portion connecting portion are provided so as to overlap with each other.

9. A process cartridge detachably mountable to an image forming apparatus main assembly, comprising:

a developer accommodating unit according to claim 1; and an electrophotographic photosensitive member integral with said developer accommodating unit.

10. An electrophotographic image forming apparatus comprising:

a process cartridge according to claim 9.

* * * * *